US005752898A

United States Patent [19]

Porkka

[11] Patent Number: 5,752,898

[45] Date of Patent: May 19, 1998

[54] BICYCLE TRAINING WEIGHT

[76] Inventor: Jonathan M. Porkka, 288 Pond St., Osterville, Mass. 02655

[21] Appl. No.: 554,544

[22] Filed: Nov. 7, 1995

[51] Int. Cl.[6] ..... A63B 69/16

[52] U.S. Cl. ..... 482/57; 482/105; 482/93

[58] Field of Search ..... 482/93, 105, 148, 482/92, 57, 109; 224/412, 414, 419, 421, 425, 426; 280/288.4

[56] References Cited

U.S. PATENT DOCUMENTS

| | | |
|---|---|---|
| 3,171,652 | 3/1965 | Newman . |
| 4,009,810 | 3/1977 | Shook . |
| 4,437,596 | 3/1984 | Shook . |
| 4,953,856 | 9/1990 | Fox, III . |
| 4,958,386 | 9/1990 | Louis-Jenne . |
| 4,964,630 | 10/1990 | Curtiss . |
| 4,997,183 | 3/1991 | Winston . |
| 5,037,087 | 8/1991 | Roth . |
| 5,178,308 | 1/1993 | Endre ..... 224/414 X |

FOREIGN PATENT DOCUMENTS 0855312 11/1960 United Kingdom .

OTHER PUBLICATIONS

Brochure—J & A Racing Products—The Weight.
Brochure—Porkka's P.I.G.G. Cycle—Weight Resistance Training.

*Primary Examiner*—Stephen R. Crow
*Assistant Examiner*—John Mulcahy
*Attorney, Agent, or Firm*—Fish & Richardson P.C.

[57] ABSTRACT

A bicycle training weight comprises an elongated tubular member having sections angularly disposed relative to one another for connection to a bicycle frame below the down tube, bottom bracket and chain stays of the frame, the weight having straps for securing the weight to the frame, cushions at the point of angular joinder of the tube sections and a cover on one end for inserting and removing individual weights from the tubular member.

16 Claims, 4 Drawing Sheets

BICYCLE TRAINING WEIGHT

BACKGROUND OF THE INVENTION

This invention relates to training weights for bicycles and more particularly to weights for bicycles adapted for mounting at a point below the bicycle frame.

Weights have been used in the past during aerobic activities, such as running, to increase resistance and enhance the training effect of the activity. Such weights often are hand held or attached to the body or clothing of the athlete.

More recently, such weights have been used on bicycles for training purposes. Weights have been designed which fit in standard bicycle water bottle brackets, or which have integral clips for mounting to the down tube of a bicycle frame. It has also been proposed to provide a weight which fits into the angle formed between the down tube of the bicycle frame, which extends downwardly from the handle bars, and the seat tube, which extends downwardly from the bicycle seat. This latter design of a weight is secured in clips which mount to the bicycle frame and provides a lower center of gravity than weights mounted directly to the down tube. Because, however, the angle between the down tube and the seat tube varies among bicycle models, one such weight will not fit a wide variety of bicycles. Additionally, typical bicycle training weights have a fixed weight. To vary the weight, a different training weight must be substituted for the one previously installed.

SUMMARY OF THE INVENTION

In general, a bicycle training weight in accordance with the invention, comprises an elongated tubular member having two sections angularly disposed with respect to one another along their respective longitudinal axes. Solid weighting material is positioned within the tubular member. Fasteners are connected to each end of the tubular member adapted for extension toward the upper surface of the tubular member defining the included angle of the tubular sections, and adapted for connection to a bicycle frame. In particular embodiments, the fasteners comprise straps which extend around the tubular member, one strap end having an adjustable buckle connected thereto for adjustably receiving the free end of the strap. Preferably, cushioning material is positioned at the point of angular joinder of the tubular sections on the upper surface and preferably a pair of such cushioning members are provided spaced from each other equidistantly from the center of a plane extending through the axis of the tubular sections.

In a particular embodiment of the invention, one end of the tubular member has an opening at the end and comprises a closure member for closing the opening. The weighting material comprises a plurality of individual weights removably positioned in the tubular member, thus permitting selective adjustment of the amount of weight utilized. The training weight can also include at the other end of the tubular member, a solid non-removable portion of weighting material, e.g., lead, solidified within the tube to provide a minimum weight, e.g. 3000 gms. The individual weights may weigh 500 gms. each so that by inserting six or seven of such weights, the total weight of the training weight is 6,000 or 6,500 gms. In a particular embodiment, the training weight is of square cross-section.

Advantageously, training weights according to the invention can be mounted underneath the down tube, bottom bracket, and chain stays of a bicycle frame to lower the center of gravity as much as possible. Being located in this position, the strap adjustments will permit connection of the training weight to a wide variety of bicycle frames. The cushions at the point of joinder of the two angular sections provide spacing between the tubular sections and the bicycle frame for fitting a variety of bicycle sizes and also provide lateral stability for the weight. In the version of the training weight in which individual weights are removable through a closure or cover. The removable individual weights permit, as noted above, adjustment of the total amount of training weight utilized.

Other features and advantages of the invention will be apparent from the description of preferred embodiments thereof, taken together with the drawings, and from the claims.

DESCRIPTION OF THE PREFERRED EMBODIMENTS

Figure 1:
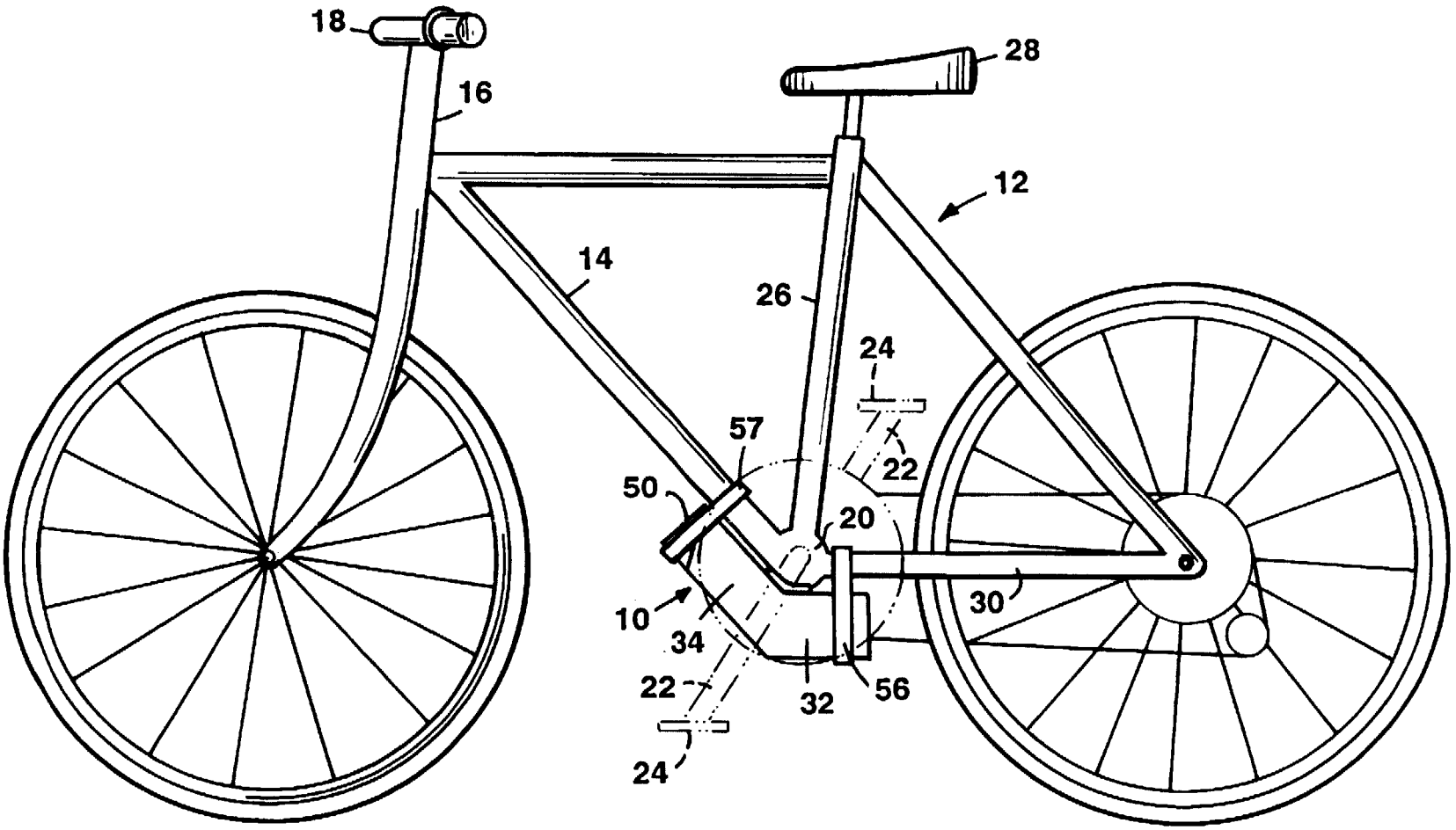
FIG. 1 is a somewhat schematic side elevation of a bicycle having a training weight according to the invention attached below the frame of the bicycle.

As illustrated in FIG. 1, a training weight 10, according to the invention, is mounted below a bicycle frame 12. The bicycle frame comprises a down tube 14 extending from the steering tube 16, above which the handle bars 18 are mounted, to a bottom bracket 20 through which the crank 22 is rotatably mounted, which crank supports the pedals 24 for the bicycle. A seat tube 26 extends from the seat 28 to the bottom bracket 20 and chain stays 30 extend rearwardly from the bottom bracket 20.

Figure 2:
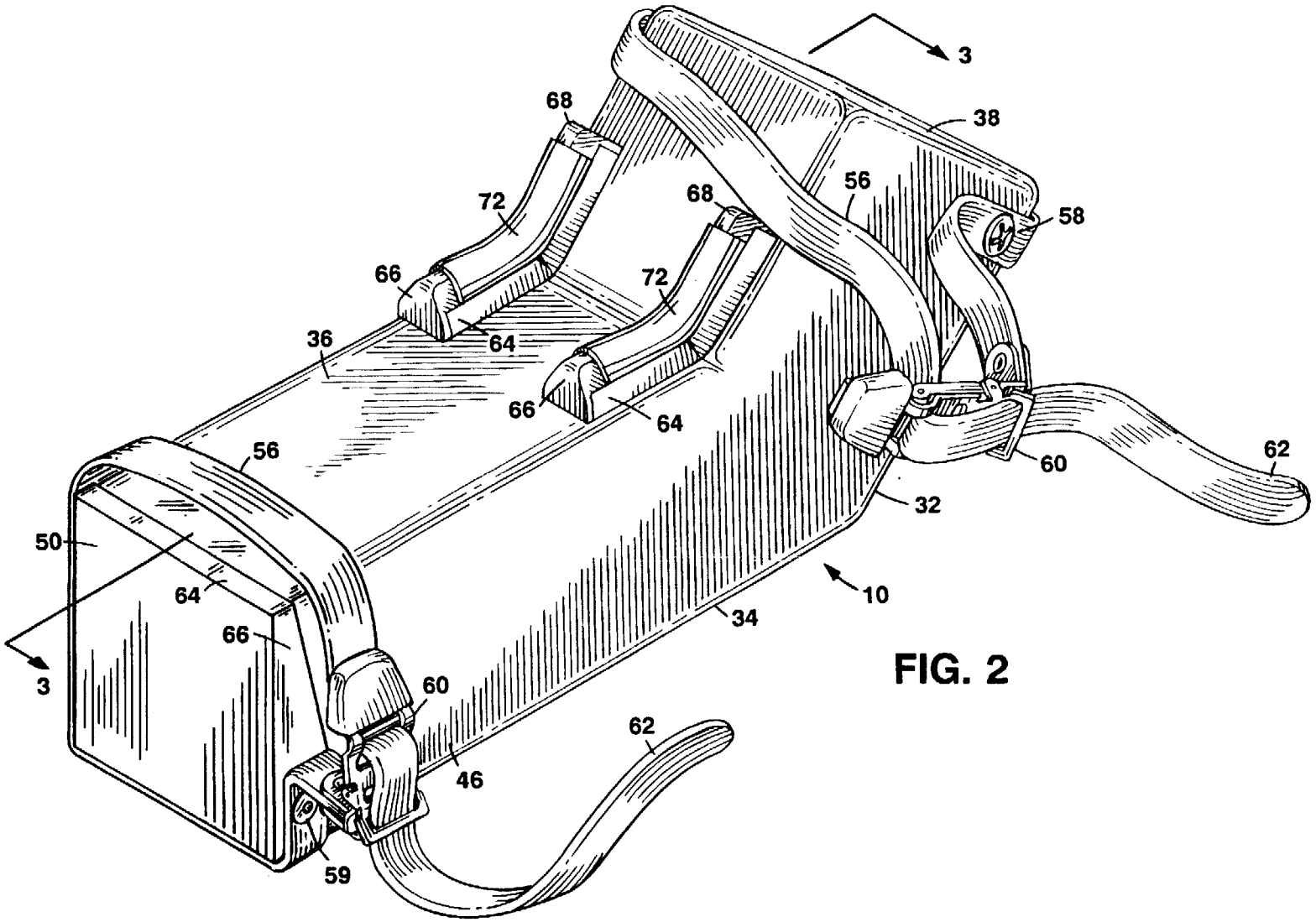
FIG. 2 is an enlarged isometric view of the training weight shown in FIG. 1.
Figure 3:
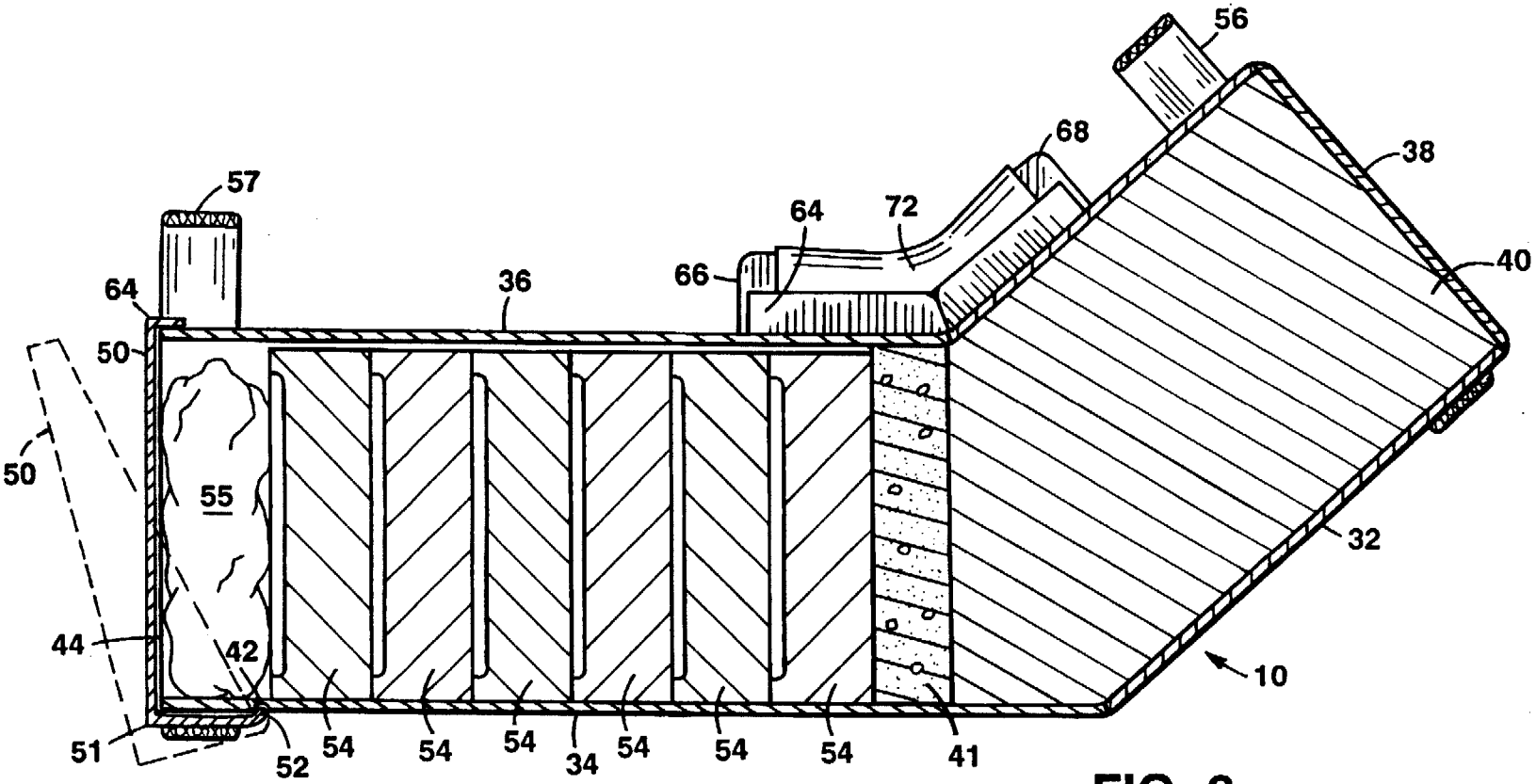
FIG. 3 is a sectional view thereof taken along the line 3—3 of FIG. 2.

As best illustrated in FIGS. 2 and 3, the training weight 10 comprises a steel tubular member of rectangular, square, preferably cross-section. The tubular member comprises two tubular sections 32,34 welded together at an angle relative to their respective longitudinal axes and, preferably, a removable closure member, i.e., cover 50. The upper surface 36 of sections 32, 34 defines an included angle of approximately 135°. One of the tubular sections 32 is shorter than the other 34, and has a steel plate 38 welded across the end of the tubular section 32 to seal that section.

As shown in FIG. 3, solid weighting material, lead 40 and cement 41, fill that section 32 of the tube and partially fill the other tubular section 34 as well. The cement 41 seals the lead and provides a smooth outer surface. The end of tubular section 34 is open and a groove 42 is formed on the bottom surface 37 of section 34 parallel to and inset from the open tube end 44, as shown in FIG. 3. The closure member, i.e., cover 50, for closing the open tube end 44, comprises a steel plate formed to provide rearwardly extending top 64, side 66, 68 and bottom 51 walls, the bottom wall 51 having an upwardly projecting flange 52 for engagement in the groove 42 on the tubular section. The cover upper wall 64 extends rearwardly only a short distance compared to cover bottom wall 51, permitting removal of the cover by pivoting about the point at which flange 52 engages groove 42, as shown in broken lines in FIG. 3. The edges of cover side walls 66, 68 extend in straight lines from the rear edge of upper wall 64 to flange 52 on the bottom wall 51, i.e. the side walls 66, 68 extend at an angle to the end of tubular section 34.

Additional solid weighting material is provided by a plurality of 6 or 7 individual weights 54 made of bronze, having outer dimensions just slightly smaller than the inner dimensions of the tubular section 34, are provided for adjustment of the total weight of the tube. The weight of the tube without the individual weights 54, is preferably approximately 3000 gms. The individual weights 54 preferably weigh about 500 gms. each. Cushioning material, e.g. crumpled paper 55, shown in FIG. 3, may be placed within the tube to prevent movement of the individual weights 54 within the tube during use.

Fastener, i.e., strap 56, adjacent one end of the tubular member, extends around the tubular section 32 and is secured by screws 58 to each of the side surfaces 46, 48 (only the screw on side 46 is shown). Fastener, i.e. strap 57 extends around cover 50 and is secured by rivets 59 to cover side walls 66, 68 at the lower, wider portions thereof. One end of each strap 56, 57 has an adjustable buckle 60 secured thereto and the other strap end 62 of each strap 56, 57 is free for insertion into the buckle. The strap ends extend toward and are positioned at the upper surface 36 of the tube. The straps 56, 57 are preferably secured so that the buckle is located closely adjacent one of the side surfaces 46, 48 and side walls 66, 68 so that it will not engage and mar the bicycle frame 12. The illustrated straps are common bicycle toe clips such as are available through Hans Johnson Co. of Dallas, Tex.

Figure 4:
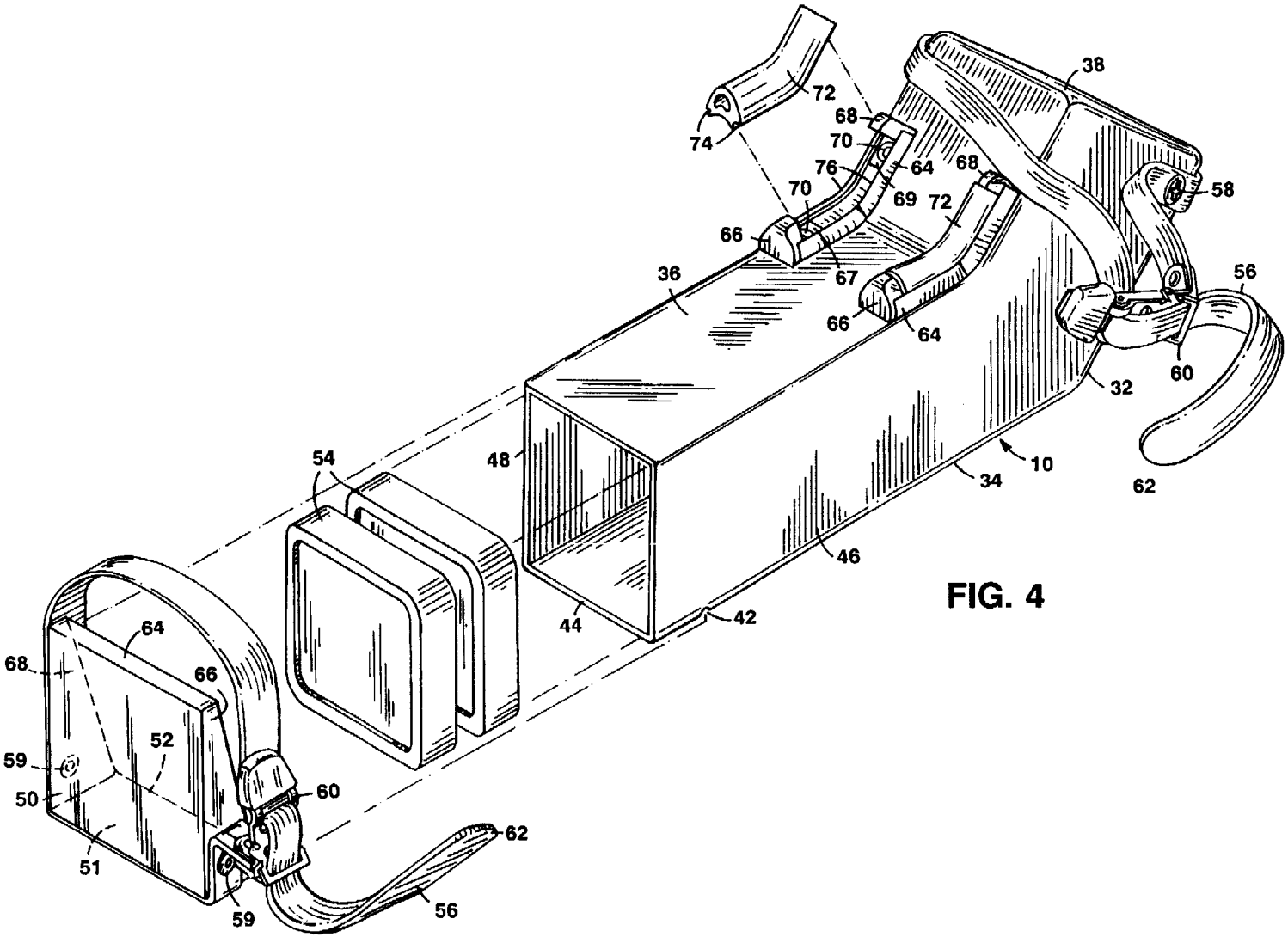
FIG. 4 is a partially exploded isometric view thereof.

On the upper surface 36, at the point of angular joinder of the two tubular sections 32, 34, a pair of elongated cushions, extending a short distance along the length are provided, laterally spaced apart equidistantly from the center of the upper surface 36, each cushion comprising a base member 64, end fittings 66, 68 which are riveted to the tubular member by rivets 70, and a cushioning member 72. The base members 64 and end fittings 66, 68 are of hard plastic. End fittings 66, 68 each have a portion 67, 69 overlying base member 64 and rivets 70 extend through overlying portions 67, 69 and base member 64 to secure the assembly to upper surface 36. An elastomeric plastic cushioning member 72 is placed between each set of the end fittings 66, 68 in a compression fit and with grooves 74 in each side the lower portion of the elastomeric members 72 engaging inwardly projecting edges 76 of the base members 64, as shown in FIG. 4. The illustrated cushions formed by these members are formed from automobile door guards.

In use, the desired amount of weight is determined and the number of individual weights 54 added or removed from the tubular member 10 to achieve the total weight desired. The flange 52 of cover 50 is then engaged in groove 42 and the cover 50 is pivoted over the open end 44 of the tubular member 10 to close the open end. The training weight 10 is then placed under the bottom bracket 20 of the bicycle frame 12 with the two cushion members 72 firmly against the bottom bracket 20. As illustrated in the drawings, the orientation of the training weight is such that the cover 50 is in the uppermost position. The straps 56, 57 are then secured around the down tube 14 and the chain stays 30 on either side of the bottom bracket 20. Advantageously, cover bottom wall 51 acts as a lever arm with flange 52 in groove 42 as the fulcrum so that pressure exerted by strap 57 on bottom wall 51 assures that cover 50 remains firmly closed when the training weights is mounted to a bicycle frame 10. If it is desired to alter the weight, the tubular member 10 can be removed from the bicycle frame 12, the cover 50 opened, and the appropriate adjustment made by adding or removing individual weights 54. To prevent rattling of the individual weights 54 within the tube 10, the empty space at the end of the tube can be filled as above noted with crumpled paper 55.

In other contemplated embodiments, the tubular member and cover may be made of molded plastic and the cushions may be molded into the plastic tubular member.

What is claimed is:

1. A training weight for connection to the underside of the frame of a bicycle, comprising:

an elongated tubular member adapted to mount to the underside of the frame, said tubular member comprising two tubular sections angularly disposed to one another along their respective longitudinal axes, the upper surface thereof comprising the surface defining the included angle of said tubular sections;

solid weighting material positioned within said tubular member; and at least one fastener positioned at said upper surface and connected to said tubular member for connecting said tubular member to the underside of said bicycle frame with said upper surface adjacent said bicycle frame.

2. The training weight claimed in claim 1 in which said at least one fastener comprises a pair of fasteners and each fastener comprises a strap, said straps connected to opposite ends of said tubular member, each said strap having a free end and another end having an adjustable buckle connected thereto for adjustably receiving said free end.

3. The training weight claimed in claim 1 in which a cushioning member is positioned on said tubular member on the upper surface thereof, said cushioning member positioned at the point of angular joinder of said tubular sections.

4. The training weight claimed in claim 3 in which said cushioning member extends a distance partially along the length of each of said tubular sections.

5. The training weight claimed in claim 4 in which a second cushioning member is provided, said cushioning members spaced from each other on either side of the center of the upper surface of said tubular member.

6. The training weight claimed in claim 5 in which said at least one fastener comprises a pair of fasteners and each fastener comprises a strap, said straps connected to opposite ends of said tubular member, each said strap having a free end and another end having an adjustable buckle connected thereto for adjustably receiving said free end.

7. The training weight claimed in claim 1 in which said solid weighting material comprises a plurality of individual weights removably positioned in said tubular member, said tubular member having an opening at one end for removal or insertion of said weights and further having a removable closure member for opening and closing said opening.

8. The training weight claimed in claim 7 in which said closure member comprises a cover extending across said opening.

9. The training weight claimed in claim 8 in which said tubular member is of rectangular cross-section, said cover is generally rectangular and has a flange at the bottom thereof and said tubular member has a groove on the bottom thereof for receiving said flange.

10. The training weight claimed in claim 7 in which said at least one fastener comprises a pair of fasteners and each fastener comprises a strap, one strap connected to said closure member and the other strap connected to said tubular member at the end opposite said one end, each said strap having a free end and another end having an adjustable buckle connected thereto for adjustably receiving said free end.

11. The training weight claimed in claim 7 in which a cushioning member is positioned on said tubular member on the upper surface thereof, said cushioning member positioned at the point of angular joinder of said tubular sections.

12. The training weight claimed in claim 11 in which said cushioning member extends a distance partially along the length of each of said tubular sections.

13. The training weight claimed in claim 12 in which a second cushioning member is provided, said cushioning members spaced from each other on either side of the center of the upper surface of said tubular member.

14. The training weight claimed in claim 13 in which said at least one fastener comprises a pair of fasteners and each fastener comprises a strap, one strap connected to said closure member and the other strap connected to tubular member at the end opposite said one end, each said strap having a free end and another end having an adjustable buckle connected thereto for adjustably receiving said free end.

15. The training weight claimed in claim 14 in which said closure member comprises a cover extending across said opening.

16. The training weight claimed in claim 15 in which said tubular member is of rectangular cross-section, said cover is generally rectangular and has a flange at the bottom thereof and said tubular member has a groove on the bottom thereof for receiving said flange.

* * * * *